US006382764B1

(12) United States Patent
Shimoda

(10) Patent No.: US 6,382,764 B1
(45) **Date of Patent: *May 7, 2002**

(54) PRINTING METHOD AND APPARATUS FOR COUNTING NUMBER OF EJECTED INK DROPLETS FOR CONTROLLING PRINTHEAD RECOVERY

(75) Inventor: Junji Shimoda, Chigasaki (JP)

(73) Assignee: Canon Kabushiki Kaisha, Tokyo (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 08/506,025

(22) Filed: Jul. 24, 1995

(30) Foreign Application Priority Data

Jul. 29, 1994 (JP) ..... 6-179217

(51) Int. Cl.[7] ..... B41J 2/165
(52) U.S. Cl. ..... 347/23; 347/35; 347/19
(58) Field of Search ..... 347/23, 17, 19, 347/14, 44, 35

(56) References Cited

U.S. PATENT DOCUMENTS

| | | | | |
|---|---|---|---|---|
| 4,313,124 A | | 1/1982 | Hara | |
| 4,345,262 A | | 8/1982 | Shirato et al. | |
| 4,459,600 A | | 7/1984 | Sato et al. | |
| 4,463,359 A | | 7/1984 | Ayata et al. | |
| 4,558,333 A | | 12/1985 | Sugitani et al. | |
| 4,608,577 A | | 8/1986 | Hori | |
| 4,723,129 A | | 2/1988 | Endo et al. | |
| 4,740,796 A | | 4/1988 | Endo et al. | |
| 4,926,196 A | * | 5/1990 | Mizoguchi et al. | 347/30 |
| 5,068,806 A | * | 11/1991 | Gatten | 395/113 |
| 5,363,134 A | * | 11/1994 | Barbehenn et al. | 347/49 |
| 5,367,325 A | * | 11/1994 | Yano et al. | 347/17 |
| 5,477,245 A | * | 12/1995 | Fuse | 347/10 |
| 5,506,611 A | * | 4/1996 | Ujita et al. | 347/86 |
| 5,576,745 A | * | 11/1996 | Matsubara | 347/14 |
| 5,617,122 A | * | 4/1997 | Numata et al. | 347/14 |
| 5,646,655 A | * | 7/1997 | Iwasaki et al. | 347/17 |
| 5,751,304 A | * | 5/1998 | Hirabayashi et al. | 347/17 |

FOREIGN PATENT DOCUMENTS

| | | | | |
|---|---|---|---|---|
| EP | 0 442 438 | | 8/1991 | |
| EP | 0 541 064 A2 | * | 5/1993 | B41J/2/36 |
| EP | 0589581 | * | 3/1994 | B41J/2/165 |
| JP | 54-056847 | | 5/1979 | |
| JP | 59-123670 | | 7/1984 | |
| JP | 59-138461 | | 8/1984 | |
| JP | 60-002368 | | 1/1985 | |
| JP | 60-071260 | | 4/1985 | |
| JP | 63-193845 | | 8/1988 | |
| JP | 2-141249 | | 5/1990 | |
| JP | 3-324648 | | 10/1991 | |
| JP | 4-93260 | | 3/1992 | |
| JP | 4-080041 | | 3/1992 | |
| JP | 4-141442 | | 5/1992 | |
| JP | 4-344255 | | 11/1992 | |
| JP | 4-358846 | | 12/1992 | |
| JP | 5-064890 | | 3/1993 | |
| JP | 5-92579 | | 4/1993 | |
| JP | 6-122206 | | 5/1994 | |
| JP | 6-238914 | * | 8/1994 | 347/23 |

OTHER PUBLICATIONS

Abstract and partial English translation of p. 2, col. 5, lines 3 –7.

* cited by examiner

*Primary Examiner*—N. Le
*Assistant Examiner*—Lamson D. Nguyen
(74) *Attorney, Agent, or Firm*—Fitzpatrick, Cella, Harper & Scinto

(57) ABSTRACT

A printing apparatus which maintains excellent image quality even in a long printing operation. In printing, the number of ink droplets (number of printing dots: A) discharged from a printhead IJH is counted by each printing operation. The counted number is accumulated to the total number (B) of printing dots from a point where a previous recovery suction has been started. Next, the total number (B) of printing dots is compared with a predetermined threshold value (C). If B<C holds, the printing is continued. If B≦C holds, recovery suction using a suction unit 5015 is performed.

29 Claims, 8 Drawing Sheets

PRINTING METHOD AND APPARATUS FOR COUNTING NUMBER OF EJECTED INK DROPLETS FOR CONTROLLING PRINTHEAD RECOVERY

BACKGROUND OF THE INVENTION

The present invention relates to a printing method and apparatus and, more particularly to a printing method and apparatus using an ink-jet printing method, which performs printing by discharging ink droplets from printhead nozzles, based on image information, on a recording medium.

Conventionally, ink-jet type printers perform image formation by discharging ink droplets from a plurality of nozzles (orifices) of a printhead, based on image information, on a recording medium. In the present invention hereinafter, "image" is defined as involving not only a usual image but also characters and symbols. The printhead typically has a plurality of nozzles connected to a plurality of orifices, a liquid chamber commonly connected to the nozzles and an ink tank which supplies ink to the chamber. The nozzles respectively have a heater as a thermal-energy generating means for heating ink to form bubbles and discharging ink as droplets from the orifice.

In the printhead having the above construction, when forming bubbles in ink on or above the heater due to heating, dissolved air in the ink becomes air bubbles. If printing time is long, the air bubbles remain within the liquid chamber, and in some cases, disturb ink-supply to the nozzles. There is a tendency that the air bubbles occur at a high temperature, and cause failure of ink-discharge in a printing operation.

To prevent such ink-discharge failure, conventional ink-jet printers have operated an air-suction pump to suck air bubbles and forcibly discharge the bubbles to the outside of the nozzles, typically using the following suction operations:

(1) Suction operation automatically performed upon installation of the printhead to a printer;

(2) Automatic suction operation periodically performed if printing is not performed for a long time. To avoid increase of ink viscosity and ink-stick to the orifices, suction is performed periodically in accordance with the length of a non-printing period, made as disclosed in Japanese Patent Application Laid-Open Nos. 60-2368 and 63-193846; and (3) Manual suction operation in accordance with the user's decision. This is made where excellent image quality cannot be obtained due to failure of ink-discharge.

However, in the case of a long printing time, these suction operations cannot prevent completely discharge failure of ink droplets caused by air bubbles in the printhead.

SUMMARY OF THE INVENTION

Accordingly, it is an object of the present invention to provide a printing method for obtaining excellent image quality even in case of long printing time, without failure of ink discharge.

According to the present invention, the foregoing object is attained by providing a printing method for performing printing on a recording medium, using an ink jet printhead, comprising a suction step of performing recovery suction on nozzles of the printhead, a recording step of performing image recording by discharging ink from the printhead, based on an input image signal, on the recording medium, a counting step of counting a number of ink droplets discharged from the printhead or a representative value of the ink droplets, an accumulation step of accumulating the number of ink droplets or the representative value, from a point where the recovery suction has been done, a comparison step of comparing the number of ink droplets or the representative value, accumulated in said accumulation step, with a predetermined threshold value, and a control step of controlling the recovery suction, based on the result from comparison in said comparison step.

It is another object of the present invention to provide a printing apparatus that obtains excellent image quality even in the case of a long printing time, without failure of ink discharge.

According to the present invention, the foregoing object is attained by providing a printing apparatus which performs printing on a recording medium, using an ink jet printhead, comprising suction means for performing recovery suction on nozzles of the printhead, recording means for performing image recording by discharging ink from the printhead, based on an input image signal, on the recording medium, counting means for counting a number of ink droplets discharged from the printhead or a representative value of the ink droplets, accumulation means for accumulating the number of ink droplets or the representative value, from a point where the recovery suction has been done, comparison means for comparing the number of ink droplets or the representative value, accumulated by said accumulation means, with a predetermined threshold value, and control means for controlling the recovery suction, based on the result from comparison by said comparison means.

In accordance with the present invention as described above, the number of ink droplets discharged from the printhead or a representative number of the ink droplets is counted. The counted number of ink droplets or the representative number is accumulated from a point where suction operation has been performed. Then the accumulated value is compared with a predetermined threshold, and in accordance with the comparison result, recovery suction is performed on the printhead nozzles.

The invention is particularly advantageous since the recovery suction can be performed on the printhead nozzles in correspondence with status of use of the printhead. This construction enables recovery suction at an appropriate point in long printing operation, thus avoids failure ink-discharge and can maintain excellent image printing.

Other features and advantages of the present invention will be apparent from the following description taken in conjunction with the accompanying drawings, in which like reference characters designate the same or similar parts throughout the figures thereof.

BRIEF DESCRIPTION OF THE DRAWINGS

The accompanying drawings, which are incorporated in and constitute a part of the specification, illustrate embodiments of the invention and, together with the description, serve to explain the principles of the invention.

DETAILED DESCRIPTION OF THE PREFERRED EMBODIMENT(S)

Preferred embodiments of the present invention will be described in detail in accordance with the accompanying drawings.

First Embodiment

Apparatus Main Body

Figure 1:
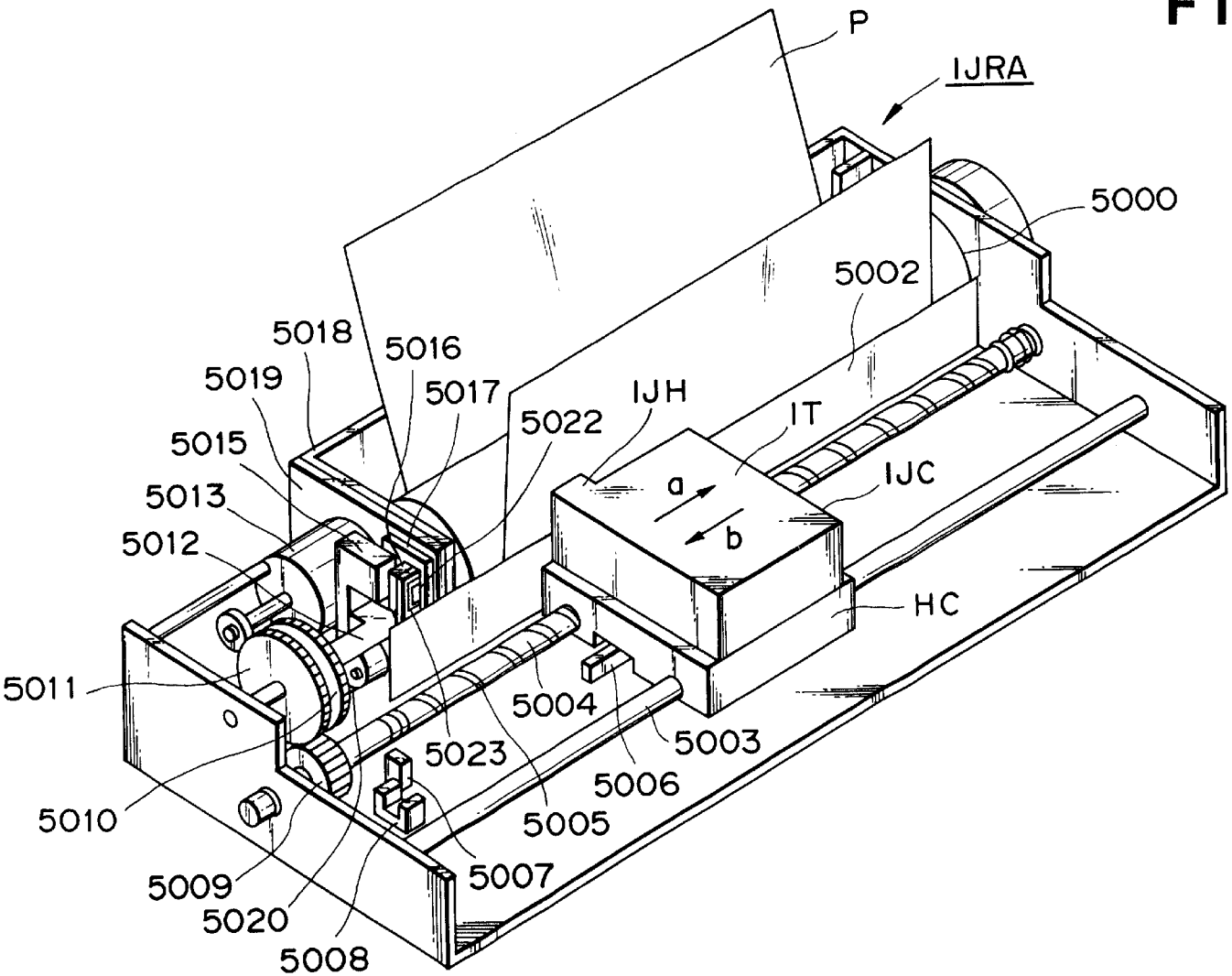
FIG. 1 is a perspective view showing the structure of an ink-jet printer IJRA as a representative embodiment of the present invention.

FIG. 1 shows the structure of a conventional ink-jet printer IJRA. In FIG. 1, a carriage HC is engaged with a spiral groove 5004 of a lead screw 5005 which rotates via driving force transmission gears 5011 and 5009 interlocking with forward/reverse rotation of a driving motor 5013. The carriage HC has a pin (not shown) and it is reciprocally moved in directions represented by arrows a and b. The carriage HC has a disposal type ink-jet cartridge IJC which integrally comprises a printhead IJH and an ink tank IT. The ink-jet cartridge IJC can be easily attached/removed. A paper-pressing plate 5002 presses a printing sheet P against a platen 5000 along the moving direction of the carriage. Photocouplers 5007 and 5008 are home position detecting members for confirming the existence of lever 5006 of the carriage in this area and changing over the rotational direction of motor 5013.

A support member 5016 supports a cap member 5022 for capping the front surface of the printhead IJH. A suction member 5015 performs suction and discharge of air bubbles and ink residue within the nozzles of the printhead IJC by sucking the inside of the cap member 5022 via a cap inner opening 5023. Member 5019 allows a cleaning blade 5017 to move in a back-and-forth direction. A main body support plate 5018 supports the member 5019 and the cleaning blade 5017. It is apparent that any well-known cleaning blade is applicable to the printer of the embodiments.

Numeral 5021 denotes a lever for starting the sucking operation of the recovery suction. The lever 5021 moves along the movement of a cam 5020 engaged with the carriage. A well-known transmission mechanism such as change-over of a clutch controls a driving force from the driving motor.

When the carriage is at the home position area, a desired processing such as capping, cleaning and suction-restoration is executed at its corresponding position by the lead screw 5005. The timing of any of these processings is not limited to the printer of the embodiments, if a desired processing is performed at a well-known timing.

Figure 2:
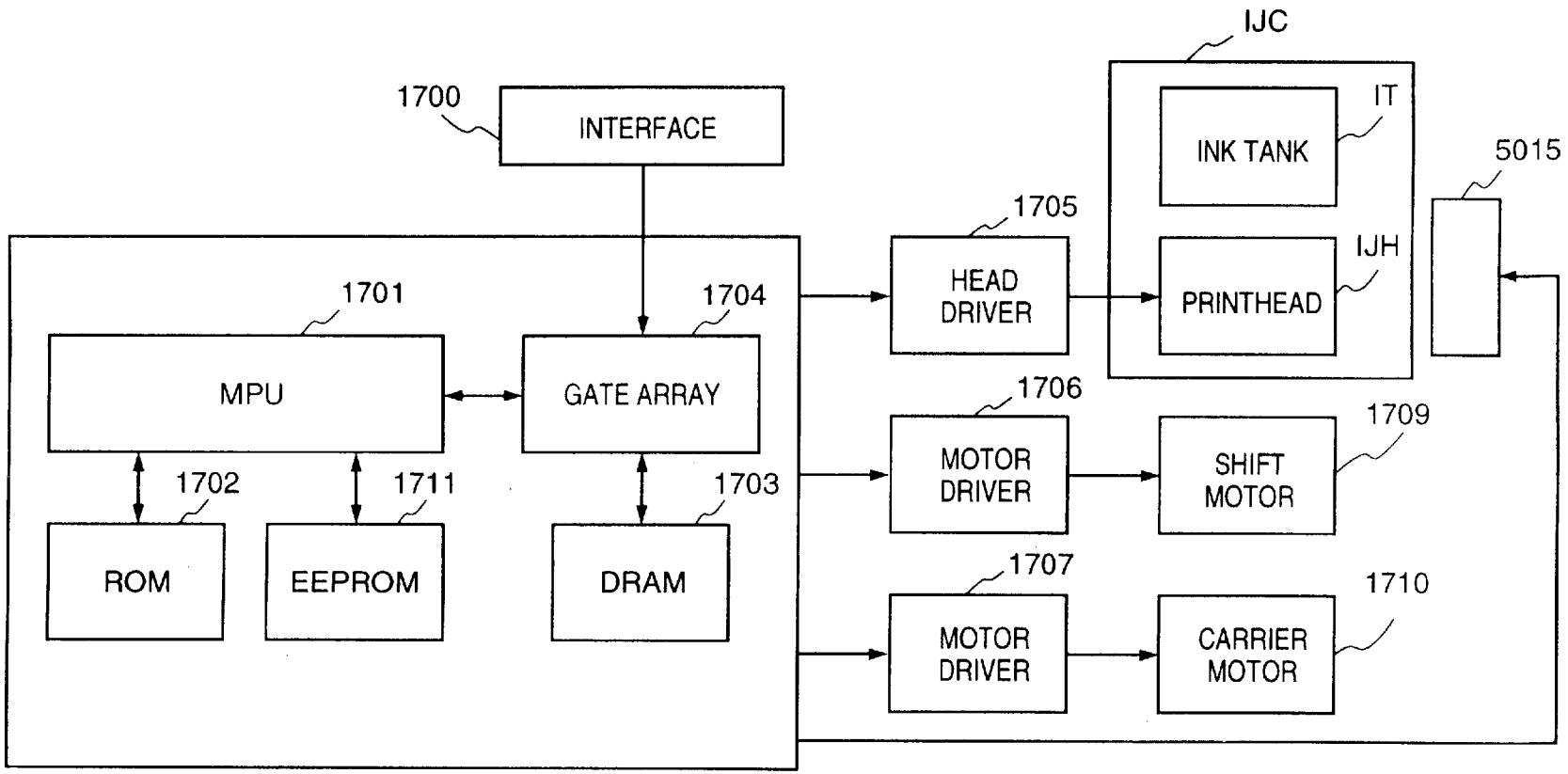
FIG. 2 is a block diagram showing the construction of a controller of the ink-jet printer IJRA.

FIG. 2 is a block diagram showing the arrangement of a control circuit of the ink-jet printer. Referring to FIG. 2, reference numeral 1700 denotes an interface for inputting a printing signal from an external unit such as a host computer; 1701, an MPU; 1702, a ROM for storing a control program (including character fonts if necessary) executed by the MPU 1701; and 1703, a DRAM for storing various data (the printing signal, printing data supplied to the printhead, and the like). Reference numeral 1704 denotes a gate array for performing supply control of printing data to the printhead IJH. The gate array 1704 also performs data transfer control among the interface 1700, the MPU 1701, and the RAM 1703. Reference numeral 1710 denotes a carrier motor for conveying the ink cartridge IJC incorporating the printhead IJH with the carriage HC; and 1709, a shift motor for shifting a printing sheet. Reference numeral 1705 denotes a head driver for driving the printhead IJH; 1706 and 1707, motor drivers for driving the transfer motor 1709 and the carrier motor 1710 respectively; and 1711, an EEPROM for maintaining information necessary for controlling suction operation even when the power of the printer is turned off.

The operation of the above control arrangement will be described below. When a printing signal is input to the interface 1700, the printing signal is converted into printing data for a printing operation between the gate array 1704 and the MPU 1701. The motor drivers 1706 and 1707 are driven, and the printhead IJH is driven in accordance with the printing data supplied to the head driver 1705, thus performing the printing operation.

Note that the controller also controls timing of recovery suction by the suction member 5015.

The printhead IJH of the present embodiment has a plurality of ink-discharge nozzles arrayed in a recording-sheet shift direction. Each of the ink droplets discharged from the nozzles corresponds to one pixel (dot) on image formation.

Figure 3:
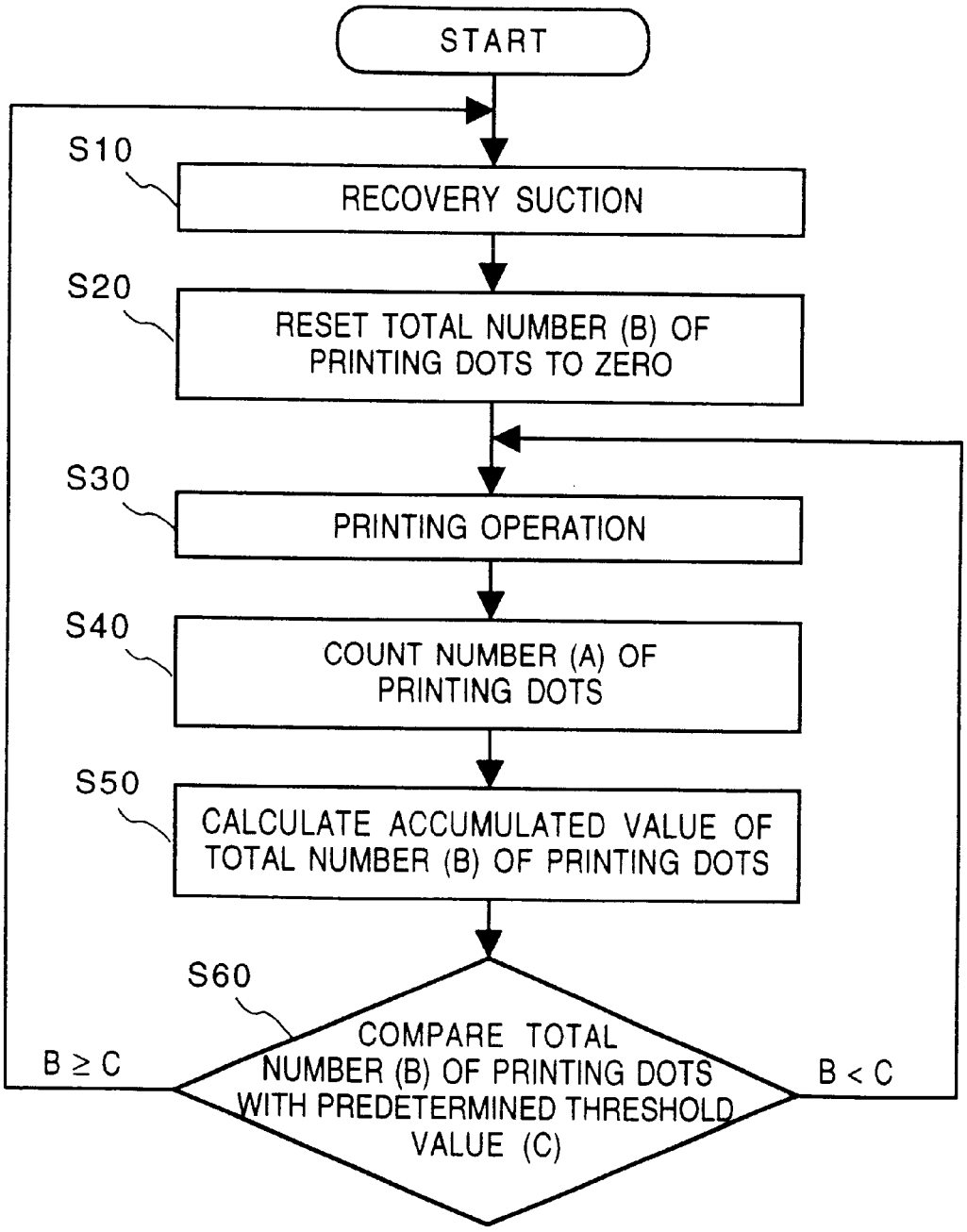
FIG. 3 is a flowchart showing recovery-suction control processing according to a first embodiment.

Next, recovery-suction control processing according to this embodiment will be described with reference to the flowchart of FIG. 3. Note that the description will be made on the assumption that the EEPROM 1711 holds the total number of ink droplets, discharged from the printhead IJH, in the printing operation after the last recovery suction operation.

As described above, when bubbles are formed on or above the heater, dissolved air in the ink becomes air bubbles. In a case where printing is successively performed for a long period of time, air bubbles accumulated within the common liquid chamber of the printhead disturb ink-supply to the nozzles. In this embodiment, the fact that ink-discharge failure depends on the total number of formed bubbles on the heaters, i.e., the total number B of printing dots is focused upon, and the recovery suction is controlled in accordance with the value of the total number B of printing dots.

In step S10, the suction unit 5015 performs recovery suction. In this step, the suction unit 5015 first performs the above-described conventional suction operations (1) suction operation automatically performed upon installation of printhead to a printer; (2) automatic suction operation periodically performed during a long non-printing period, to avoid increase of ink viscosity and ink-stick to the orifices, suction is periodically made in accordance with the length of a non-printing period, as disclosed in Japanese Patent Application Laid-Open Nos. 60-2368 and 63-193846; and (3) manual suction operation in accordance with user's decision, in a case where excellent image quality cannot be obtained due to failure of ink-discharge. Next, in step S20, as the recovery suction has been made, the value of the total number B of printing dots is reset to "0".

In step S30, a printing operation is performed. In step S40, the number of ink droplets (number of printing dots: A) discharged from the printhead IJH in the printing operation in step S30 is counted. Note that, in this embodiment, the MPU 1701 counts the number of dots which cause ink discharge, based on an input printing signal via the interface 1700. Thus, the counted number is regarded as the value of A. It is preferable that the value of the number A of printing dots corresponds to the total number of ink droplets (dots)

discharged from the printhead IJH from a standpoint of delicate recovery; however, the number A may be a representative number such as the number of recording sheets P×an average total number of printed printing dots per one recording sheet, or the like.

Thereafter, the process proceeds to step S50, in which the number A of the printing dots counted in step S30 is added to the value of the total number B of printing dots stored in the EEPROM 1711, as a new value of the total number B. Then, this value is written into the EEPROM 1711, to update the previously stored value.

In step S60, the total number B of printing dots is compared with a predetermined threshold value C. If B<C holds, it is determined that it is not time where failure of ink-discharge due to air bubbles remaining by successive printing operation may occur, and the process returns to step S30, to continue the printing operation. On the other hand, if B≧C holds, it is determined that it is time where ink-discharge failure may occur due to air bubbles remaining in successive printing operation, and the process returns to step S10, to perform the recovery suction. This operation prevents ink-discharge failure caused by air bubbles accumulated in a common liquid chamber in successive long printing operation.

According to the present embodiment, the number of ink droplets discharged from the printhead is counted, and the total number of ink droplets is accumulated by each printing operation, then when the accumulated value is equal to a predetermined threshold value or greater, recovery suction is performed. This enables execution of recovery suction at an appropriate point even in a long printing operation, thus preventing ink-discharge failure, and maintaining excellent image printing.

In this embodiment, the number of ink droplets discharged from the printhead is counted by each printing operation, however, the present invention is not limited to this counting. Furthermore, below is a preferable additional operation from a standpoint of performing a good printing operation. The discharge of ink droplets may occur when actual printing is not made. For example, immediately after the power of the printer is turned on, or if printing has not been performed more than a predetermined time, the printhead is moved to a home position to discharge ink, as a preliminary discharge, so that a printing operation can be stabilized. Thus, it may be arranged such that the number of ink droplets discharged in preliminary discharge is also counted, then the counted value is added to a count value obtained from the actual printing operation, and recovery suction is controlled based on the accumulated value. Note that the MPU 1701 also counts the number of dots which cause preliminary discharge, based on dummy printing data generated in the MPU 1701.

Second Embodiment

In this embodiment, considering the fact that as temperature rises, the frequency of occurrence of air bubbles in the printhead becomes higher, the printhead of this embodiment has a thermosensor and performs recovery suction in accordance with measured temperature. Note that the printer of this embodiment has the same structure as that described in the first embodiment, therefore the explanation of the structure of the printer will be omitted.

Figure 4:
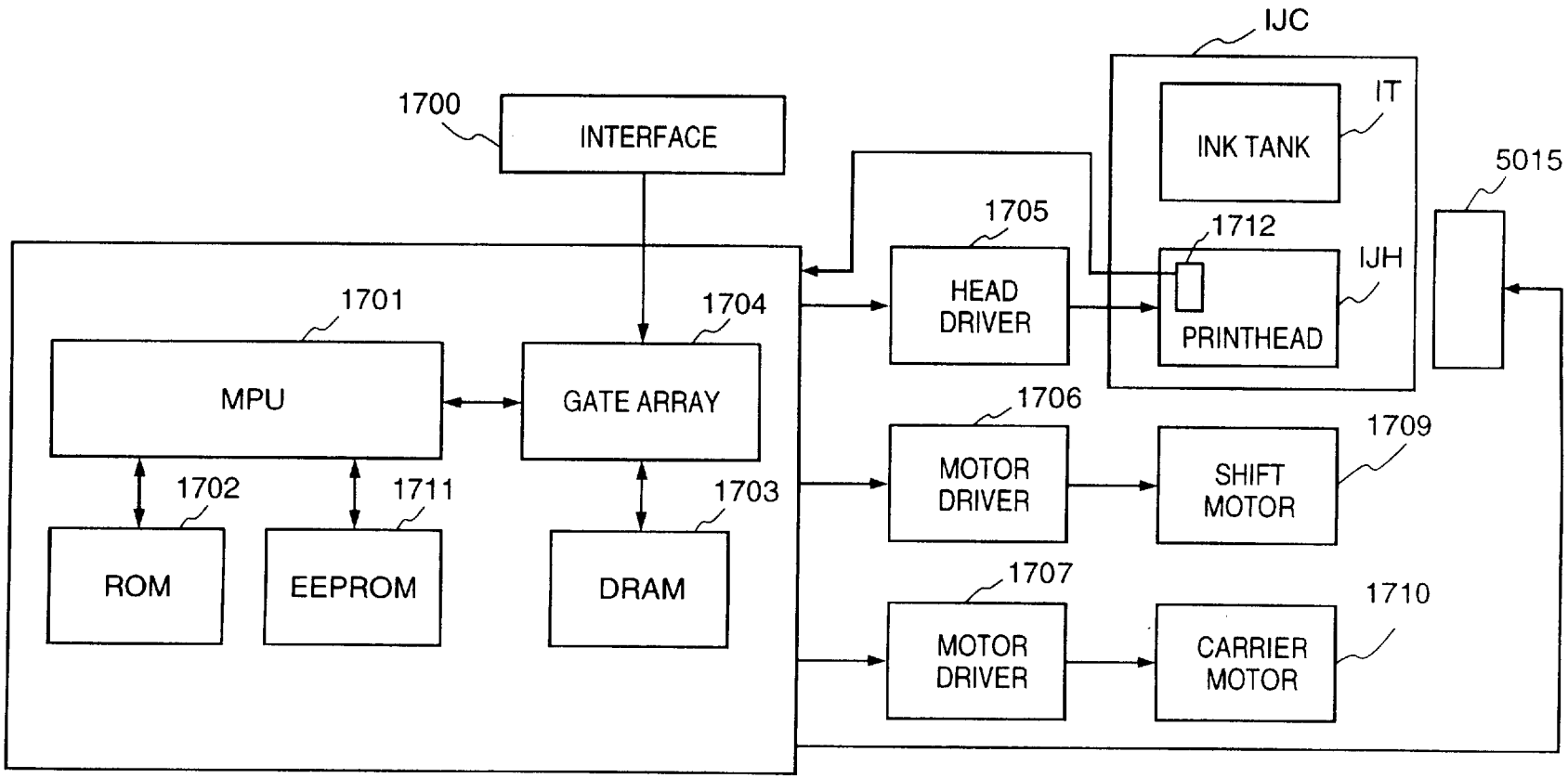
FIG. 4 is a block diagram showing the construction of a controller of the ink-jet printer IJRA according to a second embodiment.

FIG. 4 shows the construction of a controller according to this embodiment of the present invention. In FIG. 4, elements corresponding to those in FIG. 2 have the same reference numerals and the explanations of these elements will be omitted. As shown in FIG. 4, the printhead has a thermosensor 1712, and measured results are transferred to the MPU 1701.

Figure 5:
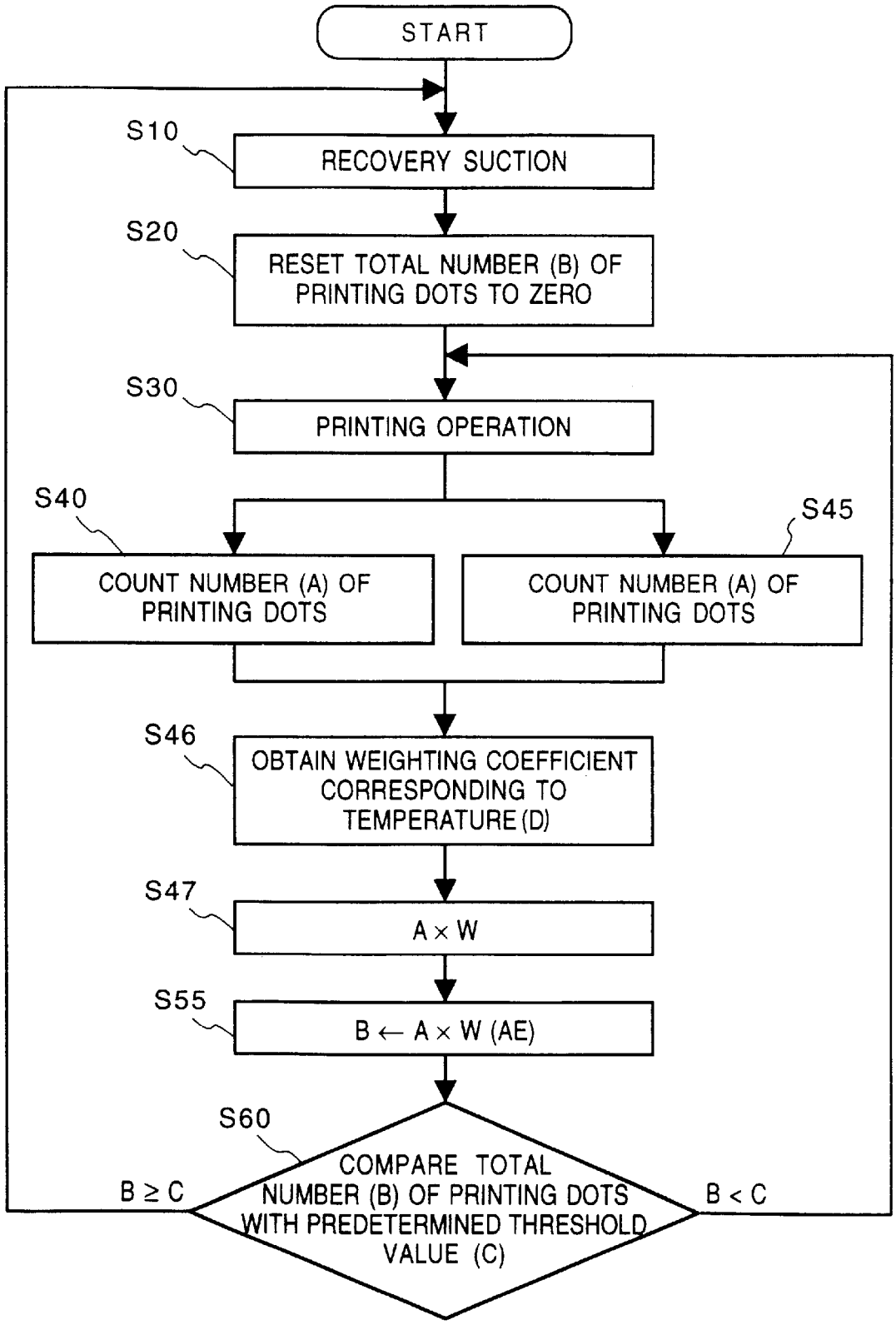
FIG. 5 is a flowchart showing recovery-suction control processing according to the second embodiment.

Next, the recovery-suction control processing according to the second embodiment will be described with reference to the flowchart of FIG. 5. Note that in FIG. 5, process steps corresponding to those in FIG. 3 have the same reference numerals and the explanations of these steps will be omitted.

In this embodiment, after the processing in steps S10 to S30, the processing in step S40 is performed, and at the same time, in step S45, internal temperature of the printhead IJH is measured by the thermosensor 1712, as a measured value D. On the other hand, the relation between the temperature values D and weighting coefficients W are stored in the form of a weighting table as shown below into the EEPROM 1711 or the ROM 1702:

TABLE 1

| MEASURED TEMPERATURE (D) | WEIGHTING COEFFICIENT (W) |
|---|---|
| D1 | W1 |
| D2 | W2 |
| — | — |
| Dn | Wn |

In Table 1, considering that as the temperature rises, the frequency of occurrence of air bubbles in the printhead nozzles becomes higher, if D1<D2<. . . Dn holds, the relation W1<W2<. . . Wn holds.

Next, in step S46, a weighting coefficient W most appropriate to the temperature value D is found in the weighting table. In step S47, the number A of printing dots, counted in step S40, is multiplied by the obtained weighting coefficient W to obtain a number AE of effective printing dots. In step S55, the number AE of the effective printing dots is added to the total number B of the printing dots, stored in the EEPROM 1711, as a new total number B. Then, this number B is written into the EEPROM 1711 to update the previously stored value.

Note that in the above processing, the actual temperature measurement by the thermosensor 1712 may be replaced with estimation of internal temperature of the printhead, by pre-storing a temperature estimation table, indicating the correlation between, e.g., the number of printing operations, the number A of printing dots or the total number B of printing dots, and internal temperature of the printhead, in the EEPROM 1711 or the ROM 1702, and referring to the table to estimate the internal temperature of the printhead.

Finally, in step S60, similar to the first embodiment, it is determined to continue the printing operation or to perform recovery suction.

Note that the values stored in the weighting table and the temperature estimation table reflect the fluctuation among apparatus depending upon quality of printers.

According to the second embodiment, the recovery suction is appropriately controlled in dependence upon internal temperature of the printhead, so that ink-discharge failure is prevented and excellent image printing can be maintained.

Third Embodiment

In the first and second embodiments, the type of printhead (e.g., color printhead, monochromatic printhead, and so on) is not taken into consideration; in this embodiment, control of recovery suction in accordance with the type of printhead will be described.

In a printer which can use plural types of printheads, condition of accumulation of air bubbles varies for each printhead, in accordance with, e.g., designing of common liquid chamber, nozzles and heaters. Therefore, the printer may comprise a sensor that discriminates the type of installed printhead or ink cartridge. On the other hand, the EEPROM or ROM may contain correction coefficients, correction terms or threshold values according to the printheads or ink cartridges of various types, so as to control recovery suction in accordance with the type of printhead or ink cartridge. In practice, the total number of printing dots is compared with a predetermined threshold value corrected with the correction coefficient or correction term according to the type of installed printhead of ink cartridge, or with a threshold value according to the type of the printhead or ink cartridge.

Figure 6:
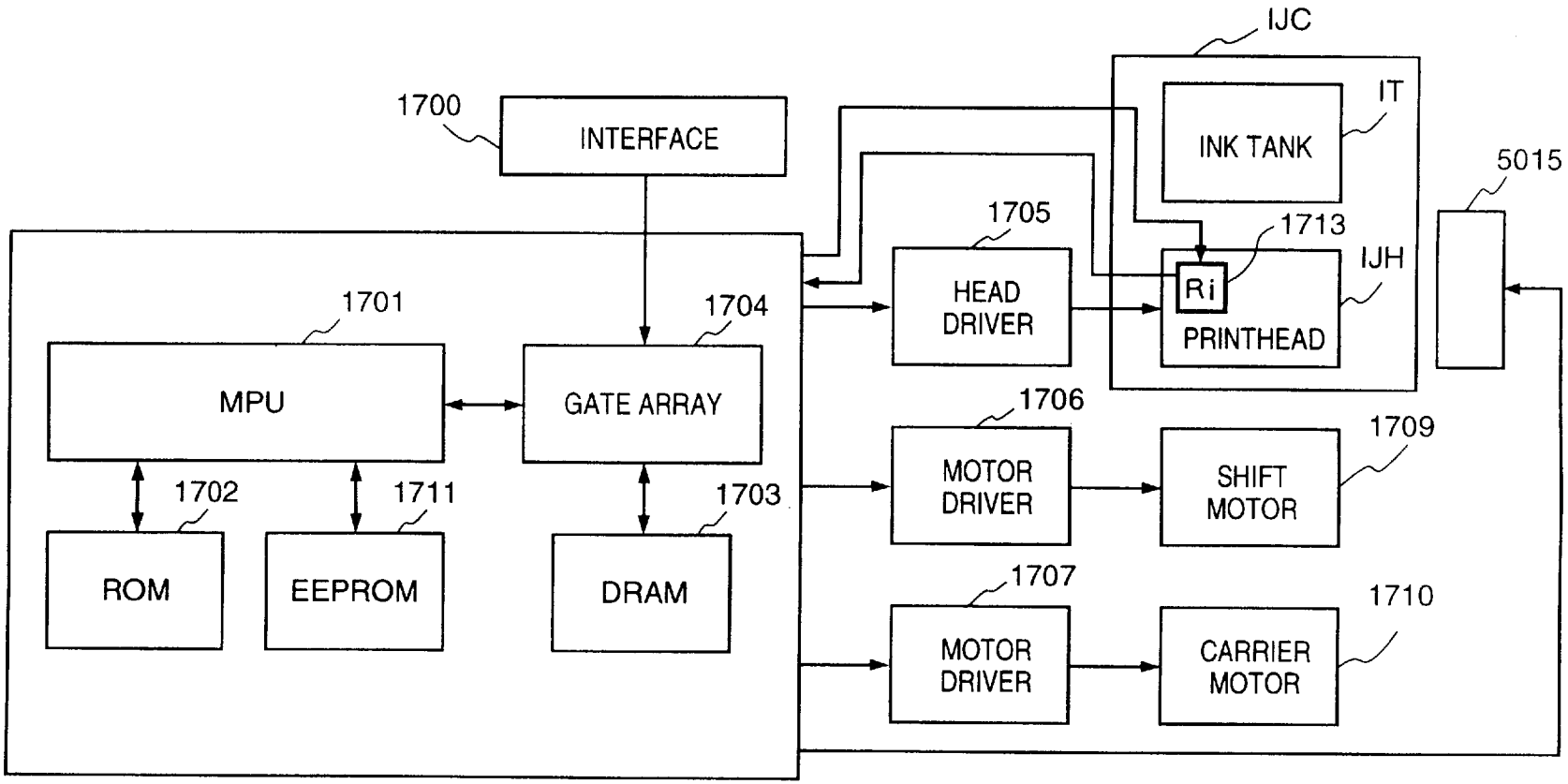
FIG. 6 is a block diagram showing the construction of a controller according to a third embodiment.

FIG. 6 shows the construction of the controller according to this embodiment. In FIG. 6, elements corresponding to those in FIG. 2 have the same reference numerals and the explanations of these elements will be omitted. As shown in FIG. 6, in this embodiment, the printhead IJH has a resistor 1713, having a unique resistance value Ri according to the type of the printhead, for discrimination of the type of printhead. Upon installing the ink cartridge onto the carriage HC, the MPU 1701 supplies low-voltage current to the resistor 1713, and based on the obtained voltage value (Vi) from the resistor 1713, discriminates the type of the printhead. In this embodiment, the number of identifiable printhead types is n.

Figure 7:
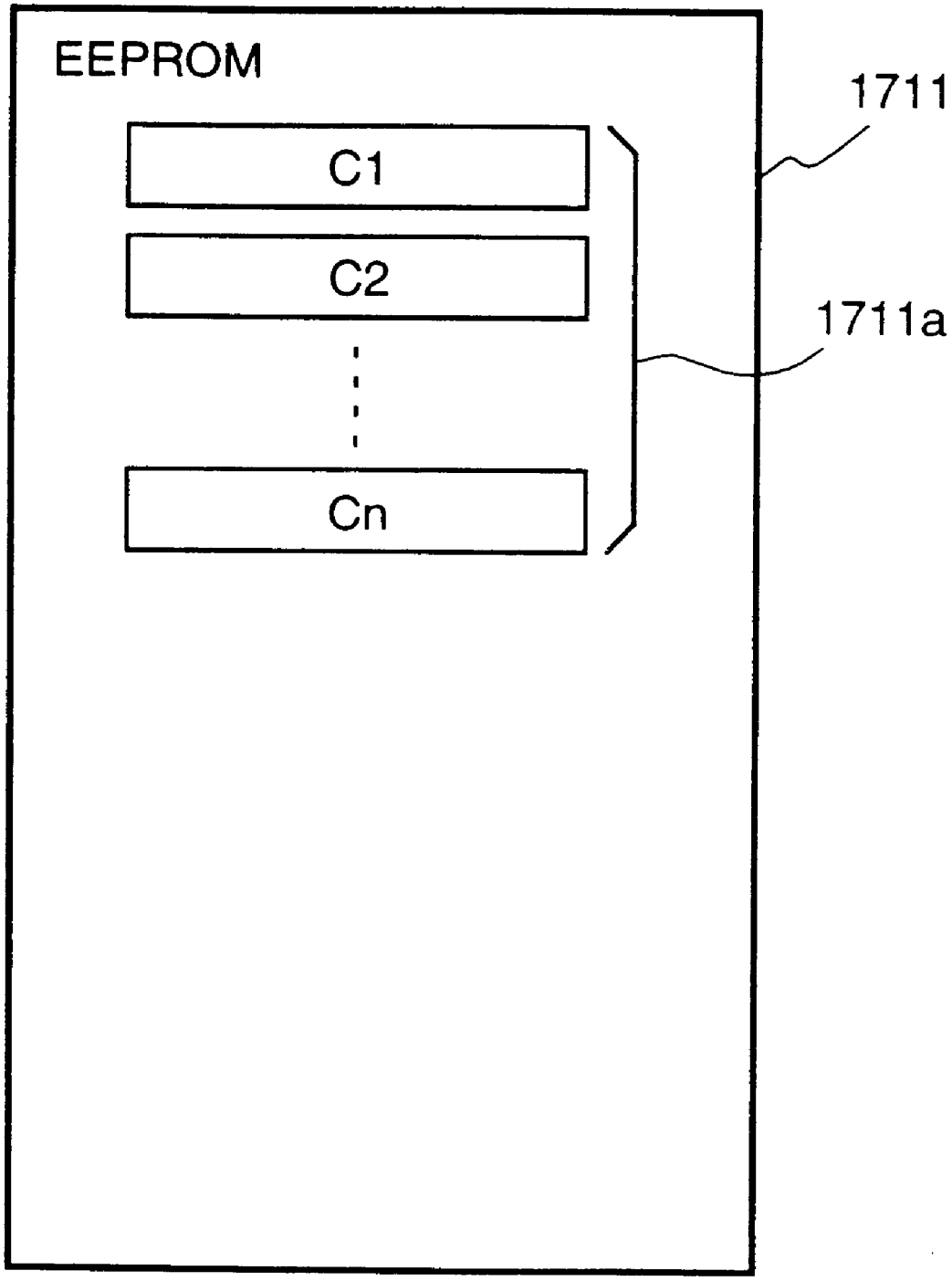
FIG. 7 is an explanatory view showing the storage areas in an EEPROM holding a plurality of thresholds (Ci: i=1, n) according to the third embodiment.

As shown in FIG. 7, the EEPROM 1711 holds n threshold values (Ci; i=1,n) 1711*a* corresponding to the n printheads. In actual recovery-suction control processing, the MPU 1701 selects one of the n threshold values 1711*a* stored in the EEPROM 1711 in accordance with the installed ink cartridge (printhead).

Figure 8:
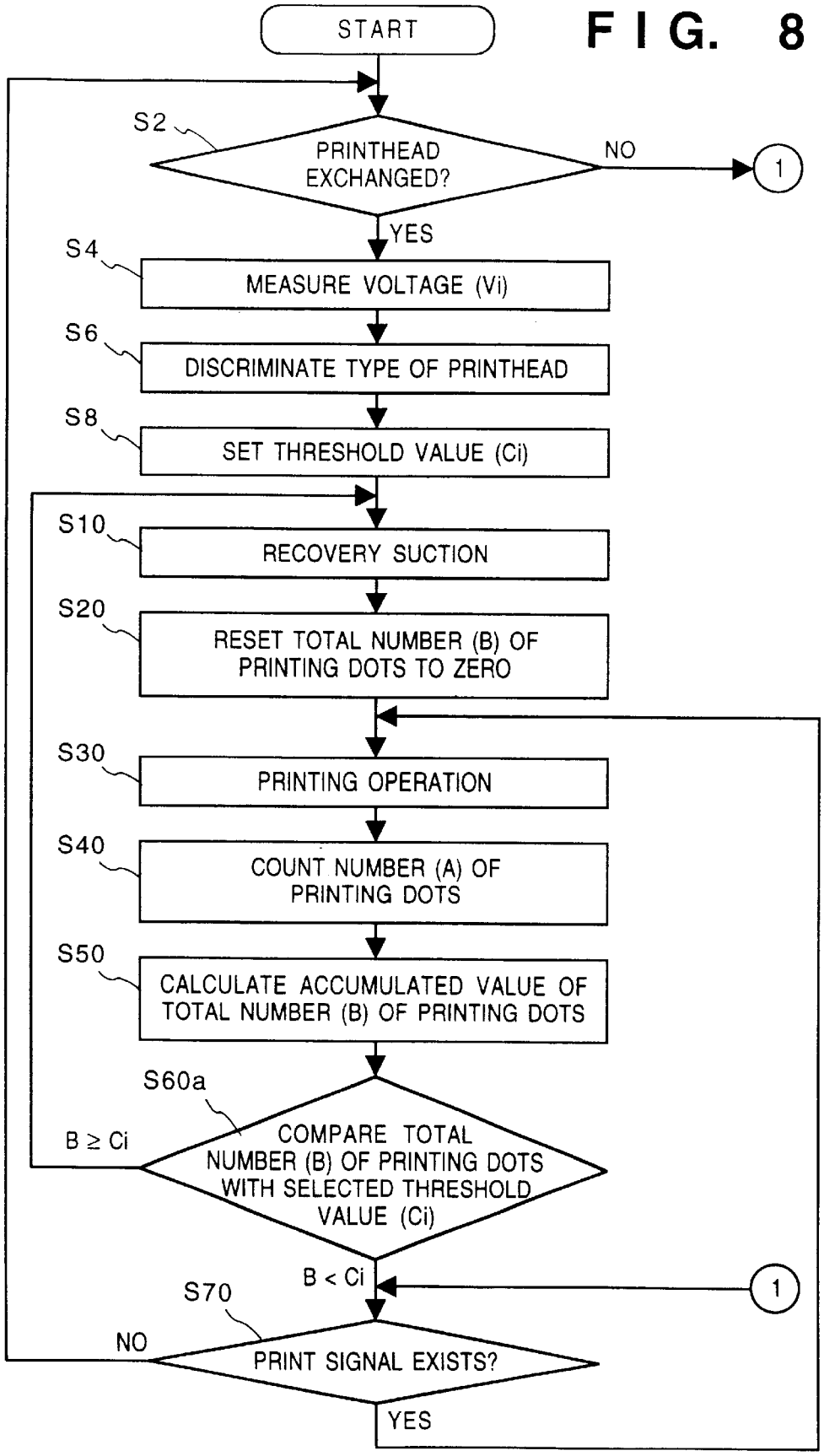
FIG. 8 is a flowchart showing recovery-suction control processing according to the third embodiment.

Next, the recovery-suction control processing according to this embodiment, performed by the printer having the above construction, will be described with reference to the flowchart of FIG. 8. Note that in FIG. 8, the process steps corresponding to those in FIG. 3 have the same reference numerals, the explanations of these steps will be omitted, and only the steps characteristic of this embodiment will be described.

In step S2, whether the printhead has been exchanged or not is determined. If NO, the process proceeds to step S70, while if YES, proceeds to step S4, in which a voltage (Vi) based on a resistance value Ri of the resistor 1713 is read, and in step S6, the type of the printhead is discriminated based on the measured voltage value. Next, in step S8, a threshold value Ci is read out of the EEPROM 1171 in accordance with the discriminated type of printhead, and set as a threshold value to be used in the recovery-suction control processing. Thereafter, the process proceeds to step S10.

After the processing in steps S10 to S50, a total number B of printing dots is compared with the selected threshold value Ci in step S60*a*. If B<Ci holds, it is determined that it is not time where air bubbles have accumulated to cause failure of ink discharge, then the process proceeds to step S70, to examine whether a print signal exists or not. If YES, the process returns to step S30, while if NO, returns to step S2.

On the other hand, is B≧Ci holds in step S60*a*, the process returns to step S10, similar to the first embodiment, to perform recovery suction.

Accordingly, in this embodiment, exchange of printhead is monitored, and when the printhead has been exchanged, a threshold value corresponding to the new printhead is set, to perform recovery suction in accordance with the type of printhead.

It should be noted that the combination of the second and third embodiments may attain recovery suction control depending upon the temperature and type of printhead.

Each of the embodiments described above has exemplified a printer, which comprises means (e.g., an electrothermal transducer, laser beam generator, and the like) for generating heat energy as energy utilized upon execution of ink discharge, and causes a change in state of an ink by the heat energy, among the ink-jet printers. According to this ink-jet printer and printing method, a high-density, high-precision printing operation can be attained.

As the typical arrangement and principle of the ink-jet printing system, one practiced by use of the basic principle disclosed in, for example, U.S. Pat. Nos. 4,723,129 and 4,740,796 is preferable. The above system is applicable to either one of the so-called on-demand type or a continuous type. Particularly, in the case of the on-demand type, the system is effective because, by applying at least one driving signal, which corresponds to printing information and gives a rapid temperature rise causing film boiling, to each of electrothermal transducers arranged in correspondence with a sheet or liquid channels holding a liquid (ink), heat energy is generated by the electrothermal transducer to effect film boiling on the heat acting surface of the printing head, and consequently, a bubble can be formed in the liquid (ink) in one-to-one correspondence with the driving signal. By discharging the liquid (ink) through a discharge opening by growth and shrinkage of the bubble, at least one droplet is formed. If the driving signal is applied as a pulse signal, the growth and shrinkage of the bubble can be attained instantly and adequately to achieve discharge of the liquid (ink) with the particularly high response characteristics.

As the pulse driving signal, signals disclosed in U.S. Pat. Nos. 4,463,359 and 4,345,262 are suitable. Note that further excellent printing can be performed by using the conditions described in U.S. Pat. No. 4,313,124 of the invention which relates to the temperature rise rate of the heat acting surface.

As an arrangement of the printing head, in addition to the arrangement as a combination of discharge nozzles, liquid channels, and electrothermal transducers (linear liquid channels or right angle liquid channels) as disclosed in the above specifications, the arrangement using U.S. Pat. Nos. 4,558,333 and 4,459,600, which disclose the arrangement having a heat acting portion arranged in a flexed region is also included in the present invention. In addition, the present invention can be effectively applied to an arrangement based on Japanese Patent Laid-Open No. 59-123670 which discloses the arrangement using a slot common to a plurality of electrothermal transducers as a discharge portion of the electrothermal transducers, or Japanese Patent Laid-Open No. 59-138461 which discloses the arrangement having an opening for absorbing a pressure wave of heat energy in correspondence with a discharge portion.

Furthermore, as a full line type printing head having a length corresponding to the width of a maximum printing medium which can be printed by the printer, either the arrangement which satisfies the full-line length by combining a plurality of printing heads as disclosed in the above specification or the arrangement as a single printing head obtained by forming printing heads integrally can be used.

In addition, not only an exchangeable chip type printing head which can be electrically connected to the apparatus main unit and can receive an ink from the apparatus main unit upon being mounted on the apparatus main unit but also a cartridge type printing head in which an ink tank is integrally arranged on the printing head itself can be applicable to the present invention.

It is preferable to add pressurization means, and preliminary heating means using electrothermal transducers, another heating element, or a combination thereof for more stable printing.

Furthermore, as a printing mode of the printer, not only a printing mode using only a primary color such as black or the like, but also at least one of a multi-color mode using a plurality of different colors or a full-color mode achieved by color mixing can be implemented in the printer either by using an integrated printing head or by combining a plurality of printing heads.

Moreover, in each of the above-mentioned embodiments of the present invention, it is assumed that the ink is a liquid. Alternatively, the present invention may employ an ink which is solid at room temperature or less and softens or liquefies at room temperature, or an ink which liquefies upon application of a use printing signal, since it is a general practice to perform temperature control of the ink itself within a range from 30° C. to 70° C. in the ink-jet system, so that the ink viscosity can fall within a stable discharge range.

In addition, in order to prevent a temperature rise caused by heat energy by positively utilizing it as energy for causing a change in state of the ink from a solid state to a liquid state, or to prevent evaporation of the ink, an ink which is solid in a non-use state and liquefies upon heating may be used. In any case, an ink which liquefies upon application of heat energy according to a printing signal and is discharged in a liquid state, an ink which begins to solidify when it reaches a printing medium, or the like, is applicable to the present invention. In this case, an ink may be situated opposite electrothermal transducers while being held in a liquid or solid state in recess portions of a porous sheet or through holes, as described in Japanese Patent Laid-Open No. 54-56847 or 60-71260. In the present invention, the above-mentioned film boiling system is most effective for the above-mentioned inks.

In addition, the ink-jet printer of the present invention may be used in the form of a copying machine combined with a reader, and the like, or a facsimile apparatus having a transmission/reception function in addition to an image output terminal of an information processing equipment such as a computer.

The present invention can be applied to a system constituted by a plurality of devices, or to an apparatus comprising a single device. Furthermore, the invention is applicable also to a case where the object of the invention is attained by supplying a program to a system or apparatus. In this case, a storage medium, storing a program according to the invention constitutes the invention. The system or apparatus installed with the program read from the medium realizes the functions according to the invention.

As many apparently widely different embodiments of the present invention can be made without departing from the spirit and scope thereof, it is to be understood that the invention is not limited to the specific embodiments thereof except as defined in the appended claims.

What is claimed is:

1. A printing method for performing image recording on a recording medium by discharging ink from an ink jet printhead, based on an input image signal, performing preliminary ink discharging unrelated to the image recording, and performing recovery suction on nozzles of the printhead, said printing method comprising:

a counting step of counting a number of ink droplets discharged from the printhead in the preliminary ink discharging and the image recording;

an accumulation step of accumulating the number of ink droplets from a point where the recovery suction has been effected;

a comparison step of comparing the number of ink droplets accumulated in said accumulation step with a predetermined threshold value; and a control step of controlling the recovery suction based on a result from comparison in said comparison step.

2. The printing method according to claim 1, wherein the preliminary ink discharging is performed prior to the image recording.

3. The printing method according to claim 1, further comprising:

a temperature estimation step of measuring temperature in the printhead; and a correction step of correcting the number of ink droplets counted in said counting step, based on the temperature measured in said temperature estimation step.

4. A printing apparatus which performs image recording on a recording medium by discharging ink from an ink jet printhead, based on an input image signal, performs preliminary ink discharging unrelated to the image recording, and performs recovery suction on nozzles of the printhead, said printing apparatus comprising:

counting means for counting a number of ink droplets discharged from the printhead by the preliminary ink discharging and the image recording;

accumulation means for accumulating the number of ink droplets from a point where the recovery suction has been effected;

comparison means for comparing the number of ink droplets accumulated by said accumulation means with a predetermined threshold value; and control means for controlling the recovery suction based on a result from comparison received from said comparison means.

5. The printing apparatus according to claim 4, wherein the preliminary ink discharging is performed prior to the image recording.

6. The printing apparatus according to claim 4, further comprising:

temperature estimation means for measuring temperature in the printhead; and correction means for correcting the number of ink droplets counted by said counting means, based on the temperature measured by said temperature estimation means.

7. The printing apparatus according to claim 6, wherein said temperature estimation means employs a temperature sensor of the printhead for temperature measurement.

8. The printing apparatus according to claim 6, wherein said temperature estimation means comprises a table for providing a relationship between a temperature and the number of ink droplets counted by said counting means.

9. The printing apparatus according to claim 4, wherein the printhead is exchangeable, and said printing apparatus further comprises discrimination means for discriminating a type of the printhead, wherein said control means controls the recovery suction in accordance with the type of the printhead discriminated by said discrimination means.

10. The printing apparatus according to claim 9, further comprising memory means for storing correction information to correct the predetermined threshold value in accordance with the type of the printhead; and correction means for correcting the predetermined threshold value, using the correction information stored in said memory means, in accordance with the type of the printhead.

11. The apparatus according to claim 10, wherein said memory means is included in a ROM or an EEPROM.

12. The printing apparatus according to claim 4, wherein the printhead is an ink-jet printhead which discharges ink utilizing thermal energy, and comprises thermal energy generating means for generating heat used for discharging ink.

13. The printing apparatus according to claim 6, wherein said temperature estimation means comprises a table for providing a relationship between a temperature and the number of ink droplets accumulated by said accumulation means.

14. The printing apparatus according to claim 4, wherein said counting means counts a value relating to the number of ink droplets discharged from the printhead.

15. The printing apparatus according to claim 14, wherein the value is derived from a number of dots which require ink discharge, based on the input image signal and dummy printing data for the preliminary ink discharging.

16. A computer program product comprising a computer readable medium storing a program for executing a print operation which includes image recording on a recording medium by discharging ink from an ink jet printhead, based on an input image signal, preliminary ink discharging unrelated to the image recording, and recovery suction on nozzles of the printhead, said operation comprising the steps of:

counting a number of ink droplets discharged from the printhead in the image recording and the preliminary ink discharging;

accumulating in an accumulation process the number of ink droplets from a point where the recovery suction has been effected;

comparing in a comparison process the number of ink droplets, accumulated in the accumulation process, with a predetermined threshold value; and controlling the recovery suction based on a result from comparison in the comparison process.

17. A printing method for performing image recording on a recording medium by discharging ink from an ink jet printhead, based on an input image signal, performing preliminary ink discharging unrelated to the image recording, and performing recovery suction on nozzles of the printhead, said printing method comprising:

a counting step of counting a number of ink droplets discharged from the printhead in the preliminary ink discharging and the image recording from a time when the recovery suction has been effected;

a comparison step of comparing the number of ink droplets counted in said counting step with a predetermined threshold value; and a control step of controlling the recovery suction, based on a result from comparison in said comparison step.

18. A printing apparatus which performs image recording on a recording medium by discharging ink from an ink jet printhead, based on an input image signal, performs preliminary ink discharging unrelated to the image recording, and performs recovery suction on nozzles of the printhead, said printing apparatus comprising:

counting means for counting a number of ink droplets discharged from the printhead by the preliminary ink discharging and the image recording from a time when the recovery suction has been effected;

comparison means for comparing the number of ink droplets counted by said counting means with a predetermined threshold value; and control means for controlling the recovery suction, based on a result from comparison received by said comparison means.

19. A computer program product comprising a computer readable medium storing a program for executing a print operation which includes image recording on a recording medium by discharging ink from an ink jet printhead, based on an input image signal, preliminary ink discharging unrelated to the image recording, and recovery suction on nozzles of the printhead, said operation comprising the steps of:

counting a number of ink droplets discharged from the printhead in the image recording and the preliminary ink discharging from a time when the recovery suction has been effected;

comparing the counted number of ink droplets with a predetermined threshold value; and controlling the recovery suction, based on a result from the comparison.

20. A printing method for performing image recording on a recording medium by discharging ink from an ink jet printhead, based on an input image signal, performing preliminary ink discharging unrelated to the image recording, and performing recovery suction on nozzles of the printhead, said printing method comprising:

a counting step of counting a number of ink droplets discharged from the printhead in the preliminary ink discharging and the image recording from a time when the recovery suction has been effected; and a control step of controlling the recovery suction if the number of ink droplets counted in said counting step reaches a predetermined threshold value.

21. The printing method according to Claim 20, wherein the preliminary ink discharging is performed prior to the image recording.

22. The printing method according to Claim 20, further comprising:

a temperature estimation step of measuring temperature in the printhead; and a correction step of correcting the number of ink droplets counted in said counting step, based on the temperature measured in said temperature estimation step.

23. A printing apparatus which performs image recording on a recording medium by discharging ink from an ink jet printhead, based on an input image signal, performs preliminary ink discharging unrelated to the image recording, and performs recovery suction on nozzles of the printhead, said printing apparatus comprising:

counting means for counting a number of ink droplets discharged from the printhead by the preliminary ink discharging and the image recording from a time when the recovery suction has been effected; and control means for controlling the recovery suction if the number of ink droplets counted by said counting means reaches a predetermined threshold value.

24. The printing apparatus according to Claim 23, wherein the preliminary ink discharging is performed prior to the image recording.

25. The printing apparatus acording to Claim 23, further comprising:

temperature estimation means for measuring temperature in the printhead; and correction means for correcting the number of ink droplets counted by said counting means, based on the temperature measured by said temperature estimation means.

26. The printing apparatus according to Claim 25, wherein said temperature estimation means comprises a table for providing a relationship between a temperature and the number of ink droplets counted by said counting means.

27. The printing apparatus according to Claim 23, wherein the printhead is exchangeable, and said printing apparatus further comprises discrimination means for control means controls the recovery suction in accordance with the type of the printhead discriminated by said discrimination means.

28. The printing apparatus according to Claim 23, wherein said ink jet printhead comprises thermal energy generating means for generating heat used for discharging ink.

29. A computer program product comprising a computer readable medium storing a program for executing a print operation which includes image recording on a recording medium by discharging ink from an ink jet printhead, based on an input image signal, preliminary ink discharging unrelated to the image recording, and recovery suction on nozzles of the printhead, said operation comprising the steps of:

counting a number of ink droplets discharged from the printhead in the image recording and the preliminary ink discharging from a time where the recovery suction has been effected; and controlling the recovery suction if the counted number of ink droplets reaches a predetermined threshold value.

* * * * *

UNITED STATES PATENT AND TRADEMARK OFFICE

CERTIFICATE OF CORRECTION

PATENT NO. : 6,382,764 B1
DATED : May 7, 2002
INVENTOR(S) : Junji Shimoda

It is certified that error appears in the above-identified patent and that said Letters Patent is hereby corrected as shown below:

Title page,
Item [56], FOREIGN PATENT DOCUMENTS,
"63-193845" should read -- 63-193846 --.
"3-324648" should read -- 3-234648 --.
"0589581" should read -- 0 589 581 --.

Column 2,
Line 43, "failure" should read -- failure of --.

Column 7,
Line 6, "terms" should read -- terms, --.
Line 12, "of ink" should read -- or ink --.
Line 60, "hand, is" should read -- hand, if --.

Column 11,
Line 1, "apparatus" should read -- printing apparatus --.

Column 13,
Line 7, "for con-" should read -- for discriminating the type of the printhead, wherein said con- --.

Signed and Sealed this

Eighth Day of October, 2002

*Attest:*

*Attesting Officer*

JAMES E. ROGAN
*Director of the United States Patent and Trademark Office*